US005238226A

United States Patent [19]

Nishimura

[11] Patent Number: 5,238,226

[45] Date of Patent: Aug. 24, 1993

[54] LEVER OPERATED HOIST

[75] Inventor: Yosaku Nishimura, Hirakata, Japan

[73] Assignee: Vital Kogyo Kabushiki Kaisha, Japan

[21] Appl. No.: 791,395

[22] Filed: Nov. 14, 1991

[30] Foreign Application Priority Data

Jul. 23, 1991 [JP] Japan ..... 3-207385

[51] Int. Cl.[5] ..... B66D 1/14

[52] U.S. Cl. ..... 254/352; 254/372; 74/523; 74/575

[58] Field of Search ..... 254/357, 346, 352, 372, 254/903, 353; 192/16, 43.1, 93 A, 94; 74/575, 523

[56] References Cited

U.S. PATENT DOCUMENTS

| | | | |
|---|---|---|---|
| 4,468,005 | 8/1984 | Nakamura | 254/352 X |
| 4,469,308 | 9/1984 | Nakamura et al. | 254/352 X |
| 4,479,635 | 10/1984 | Maeda | 254/353 X |
| 4,768,754 | 9/1988 | Nishimura | 254/352 X |

*Primary Examiner*—Andrew M. Falik
*Attorney, Agent, or Firm*—Mason, Fenwick & Lawrence

[57] ABSTRACT

In an unloaded state, by pulling the pressing drive member apart from the pressure bearing member by moving to the operation wheel side, the load sheave is allowed to rotate freely without disengaging the pinion of the drive shaft and the load sheave. In this lever operated hoist, at this time, since the conical friction member to be engaged with the pressing drive member in the rotating direction, and the intermediate member spline-coupled on the drive shaft adjacently to this conical friction member respectively have engaging parts to be engaged with each other in the rotating direction, disposed at their confronting ends, these engaging parts are engaged with each other when the load sheave rotates freely, and the contact of the torque transmitting member and other constituent members is effectively prevented, so that the load sheave is permitted to idle continously and smoothly. At the outside position in the axial direction of the torque transmitting member, a cylindrical ring for supporting the outside tubular part of the operation lever is integrally disposed, extending to the outer circumference of the operation wheel, and therefore, in the hoisting-up work, the external pressure from the outside tubular part of the operation lever is applied on the torque transmitting member through the support ring, and will not be transmitted to the operation wheel.

7 Claims, 3 Drawing Sheets

LEVER OPERATED HOIST

BACKGROUND OF THE INVENTION

1. Field of the Invention

The present invention relates to a lever operated hoist in a structure designed not to lift the load if a load heavier than a preset rated load is suspended, and more particularly to a lever operated hoist capable of adjusting the position of the lower hook in the heightwise direction under load without disconnecting the coupling of the pinion of the drive shaft and the load sheave.

2. Description of the Prior Art

In a lever operated hoist in an unloaded state, hitherto, to adjust the position by moving the lower hook in the heightwise direction by pulling the load chain fitted to the load sheave, one of the following methods was employed.

1. By moving the drive shaft to the operating wheel side, the coupling of the pinion fixed at one end of the drive shaft and the gear train for transmitting rotation to the load sheave is canceled to set the load sheave free to rotate, and the load chain is pulled in this free state.

2. By moving the pressing drive member to the operating wheel side and pulling apart from the pressure bearing member to set the load sheave free to rotate, the load chain is pulled in this free state.

These methods, however, involved the following problems, and their improvements have been desired.

(1) That is, in the first method, the load sheave cleared of coupling with the drive shaft side is braked by a small force in free state.

Therefore, in the event of an incidental disconnection of the coupling of the drive shaft and load sheave during work, the load sheave is set in free state, and the load may drop unexpectedly, or the load may be loosened to lead to an accident.

Or when pulling the load chain to move the lower hook in the uncoupled state of the drive shaft and the load sheave, this moving speed may be faster than expected by the operator, and the operator may be exposed to an unexpected accident.

Still more, when lifting up the next load, or when setting down, it is additionally necessary to move the drive shaft once uncoupled from the load sheave side in free state to the gear train side while rotating, and adjust the pinion fixed at one end of the drive shaft to be engaged with the gear train.

(2) In the second method, when the lower hook is adjusted in position in the heightwise direction in an unloaded state, the rotation of the load sheave becomes heavy, and it is difficult to rotate continuously with a small action force.

Accordingly, every time the free rotation of the load sheave becomes heavy, it was necessary to manipulate the operation lever to loosen the pressing drive member repeatedly.

Incidentally, the present inventor closely investigated into the cause of the rotation of the load sheave becoming heavy, and discovered that the pressing drive member moved in the direction of departing from the pressure bearing member contacts with the outside cover of the operation lever or other constituent member to develop a contact friction force, thereby causing to impede the free rotation of the load sheave.

SUMMARY OF THE INVENTION

The invention is devised in the light of such conventional problems, and it is hence a primary object of the invention to solve the above problems, and present a lever operated hoist capable of adjusting the position of the lower hook in the heightwise direction in an unloaded state, safely and continuously with a small action force, without disconnecting the coupling of the pinion of the drive shaft and the load sheave, and having a structure in which the preset rated load is never changed.

It is other object of the invention to present a lever operated hoist capable of freely rotating a load sheave, in an unloaded state, smoothly and continuously with a small pulling force, and promptly moving the lower hook.

It is another object of the invention to present a lever operated hoist capable of stably maintaining an always an accurate rated load, without any effect on the preset rated load (load limit), when the external force from the operation lever is applied to the operation wheel.

These and other objects and features of the invention will be better understood and appreciated by reading the detailed description illustrated by reference to the accompanying drawings and novel matters indicated in the claims thereof.

DETAILED DESCRIPTION OF THE PREFERRED EMBODIMENT

Figure 1:
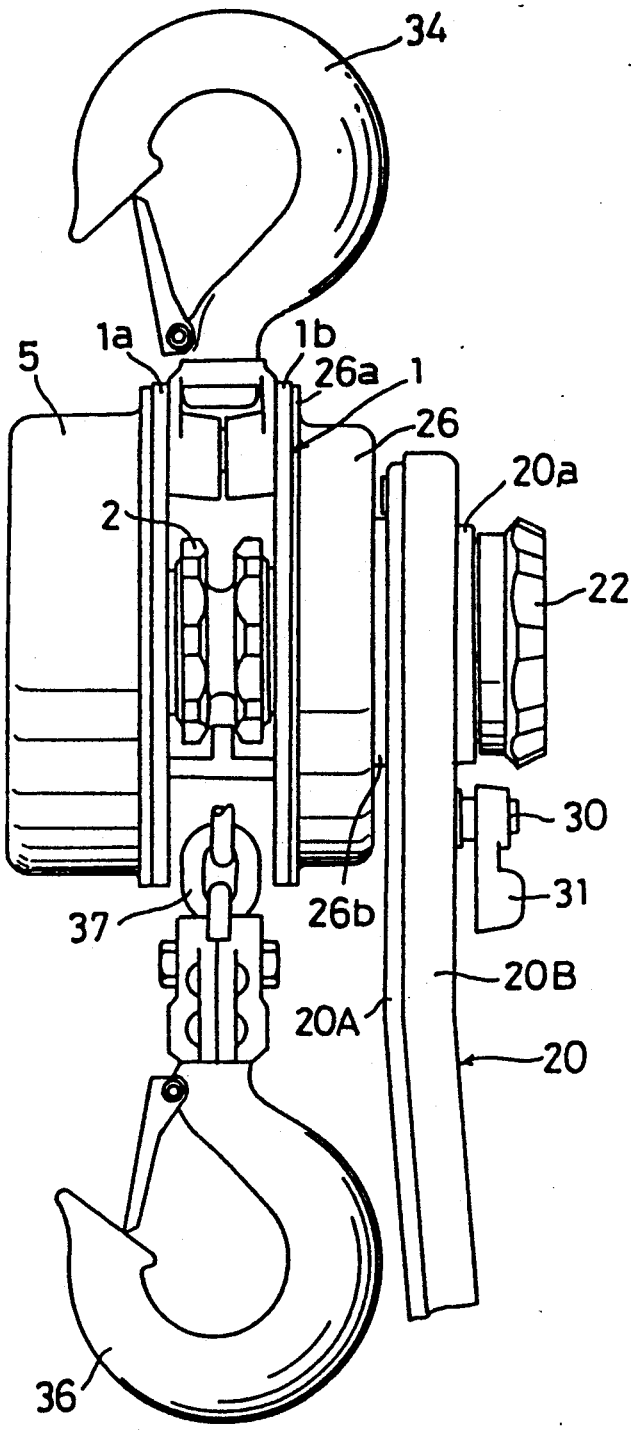
FIG. 1 is a front view showing a lever operated hoist in an embodiment of the invention.

Referring now to the drawings, an embodiment of the invention is described in detail below.

Figure 2:
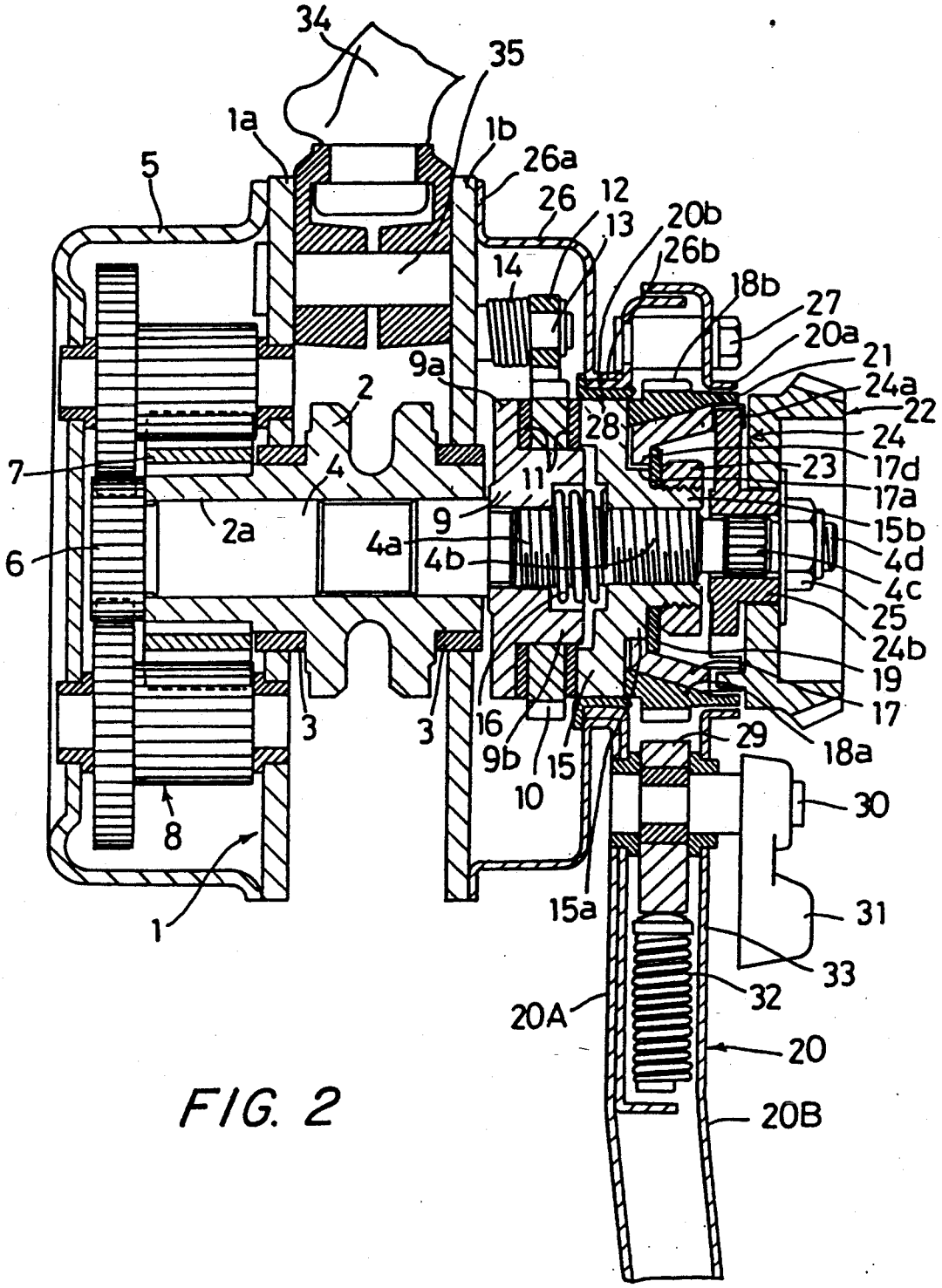
FIG. 2 is a front sectional view showing a magnified view of essential parts of the same lever operated hoist.

A lever operated hoist of the invention is shown in FIG. 1 and FIG. 2, in which the lever operated hoist comprises a hoist main body 1 composed of a pair of parallel side plates 1*a*, 1*b*, and a load sheave 2 is supported between the side plates 1*a*, 1*b* rotatably by means of bearings 3, 3. The load sheave 2 has a shaft hole 2*a* opened along its axial center, and a drive shaft 4 is inserted therein.

A gear case 5 is attached to the outside of one side plate 1*a*, and one end of the drive shaft 4 is projecting into this gear case 5. The other end of the drive shaft 4 is projecting to the outside of the other side plate 1*b*.

Between the drive shaft 4 and load sheave 2, rotation is transmitted as a pinion 6 and a gear 7 are coupled through a gear train 8. The pinion 6 is fixed at one end of the drive shaft 4, and the gear 7 is fixed on the shaft part of the load sheave 2. The gear train 8 is composed of a plurality of gears, and these gears are rotatably borne between the side plate la and the gear case 5.

In the portion of the drive shaft 4 projecting to the outside of the side plate 1*b*, first right-hand threads 4*a* and second right-hand threads 4*b* are formed continuously from the side closer to the side plate 1*b*. A pressure bearing member 9 is screwed and fixed in the first right-hand threads 4*a*, and a pressing drive member 15 is engaged with the second right-hand threads 4*b*.

The pressure bearing member 9 is composed of a disc part 9*a* and boss part 9*b* which are formed into one body. The disc part 9a is formed at the side plate 1b side, and the boss part 9b is projecting from this disc part 9a to the pressing drive member 15 side. On the boss part 9b, a ratchet wheel 10 and a pair of friction members 11, 11 are rotatably supported in the circular hole parts disposed in the central parts thereof. The ratchet wheel 10 is intended to prevent rotation in the reverse direction, and the pair of friction members 11, 11 tightly contact both sides of the ratchet wheel 10.

The ratchet wheel 10 and the pair of friction members 11, 11 are pressed to the disc part 9a of the pressure bearing member 9 by the pressing force of the pressing drive member 15 in the axial direction. A thrusting spring 16 is loaded between the pressure bearing member 9 and the pressing drive member 15.

The thrusting spring 16 thrusts the pressure bearing member 9 and pressing drive member 15 in the directions to depart from each other, and resisting the thrusting force of the thrusting spring 16, the ratchet wheel 10 and friction members 11, 11 are pressed to the disc part 9a of the pressure bearing member 9.

A ratchet pawl 12 is pivoted on a shaft 13 projecting from the side plate 1b, and is engaged with the ratchet wheel 10 by the elastic thrusting force of a spring 14 loaded in the shaft 14. Accordingly, the ratchet wheel 10 is allowed to rotate only in the hoisting-up direction of the load sheave 2.

The ratchet wheel 10, pair of friction members 11, 11, and ratchet pawl 12 are combined to compose a driving force transmitting mechanism for transmitting the torque of the pressing drive member 15 in the hoisting-up direction to the pressure bearing member 9.

Figure 3:
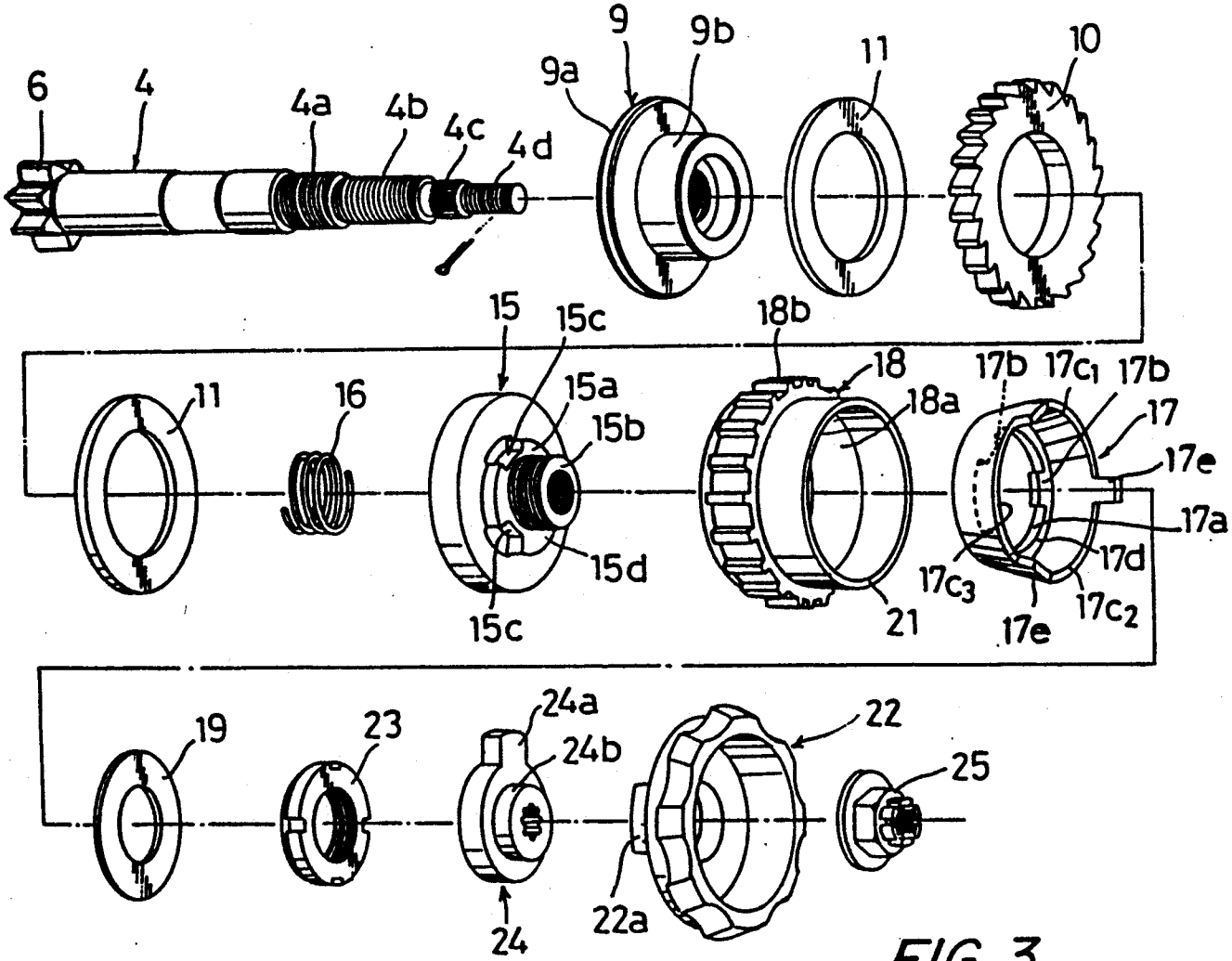
FIG. 3 is an explosed perspective view of essential parts of the same lever operated hoist.

The pressing drive member 15 has a first boss part 15a of large diameter formed on its outside end face as shown in FIG. 3, and a second boss part 15b of a smaller diameter is formed on the end face of the first boss part. On the outer circumference of the first boss part 15a, a plurality of notches 15c (three in this example) are disposed at equal intervals in the circumferential direction. A male threading 15d is cut in the outer circumference of the second boss part 15b.

Numeral 17 is a conical friction member. The conical friction member 17 is hollow, and its outer circumference is formed in a conical surface having a specified peak angle. At the end part of the small diameter side of this conical friction member 17, a flange 17d is formed, extending inward in the radial direction, and a circular hole 17a is formed at the inner end of the flange 17d. The first boss part 15a is penetrated in the pressing drive member 15.

On the inner circumference of this circular hole 17a, a plurality of engaging protrusions 17b are formed. These engaging protrusions 17b, 17b . . . are engaged with the plurality of notches 15c, 15c . . . disposed in the first boss part 15a respectively to form spline coupling. By contrast, at the larger diameter end side of the conical friction member 17, a plurality of axial engaging dents (three in this example) are formed at equal intervals in the circumference direction.

The conical friction member 17 is fitted in a conical hole 18a of a torque transmitting member 18, and is pressed to the inside in the axial direction by a thrusting member 19.

The torque transmitting member 18 is to transmit the operating force of an operation lever 20 to the conical friction member 17 as a torque, and a gear 18b is formed on its outer circumference. A support ring 21 is formed at the outside position in the aixal direction of this torque transmitting member 18.

The support ring 21 is a cylindrical one for supporting an outer tubular part 20a of the operation lever 20, and is extended to the outer circumference of an operation wheel 22 mentioned below.

The thrusting member 19 is a belleville spring or a coil spring, and is fitted in the second boss part 15b of the pressing drive member 15 in the internal space of the conical friction member 17, and its outer circumferential edge part abut against the inner flange 17d of the conical friction member 17.

The thrusting member 19 is tightened by a nut member 23 screwed in the second boss part 15b, and the conical friction member 17 is pressed to the inside in the axial direction. As a result, both the conical surfaces of the conical friction member 17 and torque transmitting member 18 contact with each other in friction.

By adjusting the tightening extent by the nut member 23, the pressing force by the conical friction member 17 is set, and the value of the rated load suspended on the load sheave 2 is set.

As the large diameter side of the conical friction member 17, an intermediate member 24 is spline-coupled to the spline 4c formed in the drive shaft 4. On the outer circumference of the intermediate member 24, one engaging protrusion 24a is formed, and this engaging protrusion 24 is engaged with one of the three engaging dents of the conical friction member 13 for mutual engagement, for example, the engaging dent 17c1.

The circumferential length of the engaging protrusion 24a is sufficiently shorter than the peripheral length of the engaging dent 17c1. Accordingly, when the intermediate member 24 is rotated together with the drive shaft 4 in the hoisting-down direction, and the conical friction member 17 is rotated in the hoisting-down direction at a slightly slow rotating speed than the drive shaft 4, the conical friction member 17 is moved to the pressure bearing member 9 side along the drive shaft 4 until the engaging protrusion 24a abuts against the side wall of the engaging dent 17c1.

This is because the conical friction member 17 rotates in assembly with the pressing drive member 15 and torque transmitting member 18, while the pressing drive member 15 rotates relatively to the right-hand threads 4b of the drive shaft 4 to advance on the right-hand threads 4b.

Outside the intermediate member 24 in the axial direction, the boss part 24b is disposed integrally, and the operation wheel 22 is rotatably mounted thereon. The operation wheel 22 is prevented from falling off the drive shaft 4 by means of the intermediate member 24 and nut 25. This nut 25 is driven into the small diameter threaded part 4d formed in the small diameter part at the front end of the drive shaft 4.

The operation wheel 22 has one engaging protrusion 22a disposed oppositely to the large diameter side of the conical friction member 17. This engaging protrusion 22a is engaged with one of the engaging dents of the conical friction member 17, for example, the engaging dent 17c2. The circumferential length of this engaging protrusion 22a is sufficiently smaller than the peripheral length of the engaging dent 17c2 as is the engaging protrusion 24a of the intermediate member 24.

The engaging protrusion 22a and the engaging protrusion 24a are engaged with different engaging dents of the conical friction member 17. The sum of the peripheral length of the engaging protrusion 22a and the peripheral length of the engaging protrusion 24*a* is set to be larger than the peripheral length of the engaging dent 17*c*. Thus, the engaging protrusion 22*a* and engaging protrusion 24*a* will not be engaged with the same engaging dent 17*c*.

At the face side of the side plate 1*b*, a brake cover 26 is provided. The brake cover 26 covers all of the pressure bearing member 9, ratchet wheel 10 and ratchet pawl 12, and a part of the pressing drive member 15. At one end of the brake cover 26, a flange 26*a* is formed, and the part of this flange 26*a* is fastened with screw to the side plate 1*b*. At the other end of the brake cover 26, a tubular part 26*b* is formed. This tubular part 26*b* is close to the outer circumference of the pressing drive member 15.

On the tubular part 26*b*, the operation lever 20 is held rotatably on both brake cover 26 and operation wheel 22. The operation lever 20 is designed to drive and rotate the pressing drive member 15 in the hoisting-up or hoisting-down direction through the torque transmitting member 18 and conical friction member 17.

The operation lever 20 comprises an inside cover 20A and an outside cover 20B made of steel plate, and the outside cover 20B is fitted to the outside of the inside cover 20A, and the peripheral parts of the both covers are coupled together into one body by a plurality of bolts 27. The entire surface of the torque transmitting member 18 is covered by the peripheral parts of the both covers 20A, 20B.

The inside cover 20A has an inside tubular part 20*b* disposed oppositely to the tubular part 26*b* of the brake cover 26, and this inside tubular part 20*b* is inserted into the inside of the tubular part 26*b* and is held rotatably therein. Numeral 28 is a coupling member for preventing disengagement of the operation lever 20 and brake cover 26.

Outside the outside cover 20B in the axial direction, the outside tubular part 20*a* is formed. The outside tubular part 20*a* is positioned on the outer circumference of the support ring 21 of the torque transmitting member 18.

Inside the operation lever 20 is incorporated a rotating direction changeover pawl 29. The rotating direction changeover pawl 29 changes over the rotating direction of the torque transmitting member 18, conical friction member 17 and pressing drive member 15 between the hoisting-up direction and hoisting-down direction.

This rotating direction changeover pawl 29 is fixed on a support shaft 30. The support shaft 30 is rotatably held on the operation lever 20, and its one end is projecting outside from the operation lever 20. In the projecting part of the support shaft 30, a handle 31 for changeover is fitted.

By turning and manipulating the handle 31, the rotating direction changeover pawl 29 is selectively changed over in two engaging positions (hoisting-up position and hoisting-down position) to be engaged with the gear 18*b* of the torque transmitting member 18, and the neutral position not engaged with the gear 18*b*.

At these two engaging positions, the reciprocal rotary manipulation of the operation lever 20 is transmitted to the torque transmitting member 18 through the rotating direction changeover pawl 29. Accordingly, the torque transmitting member 18 rotates the pressing drive member 15 in the hoisting-up direction or hoisting-down direction through the conical friction member 17. On the other hand, at the neutral position, the torque transmitting member 18 is disengaged from the rotating direction changeover pawl 29 of the operation lever 20, and is not rotated in either direction.

The lower end of the rotating direction changeover pawl 29 is elastically pressed upward by a positioning member thrust be a coil spring 32. By the action of the pressing force of the coil spring 32, the rotating direction changeover pawl 29 is elastically held at either one of the two engaging positions or at the neutral position.

Numeral 34 is an upper hook for suspending the hoist main body 1, and it is fitted to a coupling shaft 35 for coupling the side plates 1*a*, 1*b*. Numeral 36 is a lower hook for suspending the cargo, and it is attached to the lower end of a load chain 37.

In thus composed lever operated hoist, the operation is described below.

Hoisting-up action

With the rotating direction changeover pawl 29 selected at the hoisting-up position, the operation lever 20 is turned reciprocally. Then, within the preset rated load, the torque transmitting member 18 rotates the conical friction member 17 in the hoisting-up direction through conical surface contact with the conical friction member 17 by the pressing force of the thrusting member 19.

This torque is transmitted to the pressing drive member 15 by the engagement of the engaging protrusion 17*b* of the conical friction member 17 and the notch 15*c* of the pressing drive member 15.

In consequence, the pressing drive member 15 spirally advances inside in the axial direction on the right-hand threads 4*b* of the drive shaft 4, and rotates the ratchet wheel 10 and the pressure bearing member 9 integrally through the friction members 11 at its both sides, so that the drive shaft 4 is rotated in the hoisting-up direction (clockwise as seen from the operation wheel 22 side).

The torque of the drive shaft 4 is transmitted to the load sheave 2 through the gear train 8 from the pinion 6, and the load sheave 2 rotates in the same direction as the drive shaft 4. As a result, the cargo within the rated load suspended on the lower hook 36 of the load chain 37 is hoisted up by the reciprocal rotary manipulation of the operation lever 20.

On the other hand, when a cargo heavier than the rated load is suspended on the lower hook 36, if the operation lever 20 is turned reciprocally, the conical surfaces of the torque transmitting member 18 and conical friction member 17 slip on each other, and the conical friction member 17 is not rotated in the hoisting-up direction. Hence, the drive shaft 4 and load sheave 2 are not rotated in the hoisting-up direction, and hoisting of the cargo heavier than the rated load is automatically arrested, so that the safety of the job is guaranteed.

Meanwhile, during operation of the lever operated hoist, a reaction of the driven side is applied to the operation lever 20 through the support shaft 30, and in manipulation of the operation lever 20, the operation lever 20 is not vertical to the drive shaft 4 but is inclined. In this case, the outside tubular part 20*a* of the operation lever 20 is supported on the outer circumference of the support ring 21 of the torque transmitting member 18, so that the outer tubular part 20*a* does not directly contact with the operation wheel 22.

As a result, external pressure from the operation lever 20 is not applied to the operation wheel 2 to affect the preset rated load (load limit) by the thrusting member 19, so that an accurated rated load is always kept stably.

Hoisting-down action

By contrast, with the rotating direction changeover pawl 29 selected at the hoisting-down position, the operation lever 20 is turned reciprocally. The pressing drive member 15 is moved in the direction not to press the ratchet wheel 10 and friction members 11, 11, by the torque transmitting member 18 and conical friction member 17, and the pressure bearing member 9 and the drive shaft 4 are allowed to rotate in the hoisting-down direction by a specific angle to the ratchet wheel 10.

Accordingly, the cargo within the rated load suspended on the lower hook 36 is intermittently hoisted down by repetition of reciprocal rotary manipulation of the operation lever 20.

Idling action

In an unloaded state having nothing suspended on the lower hook 36, the rotating direction changeover pawl 29 is selected at the neutral position, and the operation wheel 22 is once idled in the clockwise direction as far as rotating freely, then the operation wheel 22 is quickly turned in the hoisting-down direction to release the pressed state of the pressing drive member 15, and the end side of the load chain 37 is pulled, so that the load sheave 2 is free to rotate.

That is, first by rotation of the operation wheel 22, the engaging protrusion **22*a* collides against the side wall 17*e* of the engaging dent 17*c*2 of the conical friction member 17, thereby rotating the conical friction member 17 counterclockwise. By this rotation and the thrusting force of the thrusting spring 16, the pressing drive member 15 is weakened in the frictional force against the friction member 9**.

In succession, the end side of the load chain 37 is pulled to rotate the load sheave 2, the drive shaft 4 is also rotated in the same direction by the gear train 8 engaged with the gear 7 of the load sheave 2.

If the drive shaft 4 rotates, however, the pressing drive member 15 is pressed outside in the axial direction by the thrusting member 16 installed between itself and the pressure bearing member 9, and the frictional force against the friction member 11 is small, so that the pressing drive member 15 is rotated at a slightly slower speed than the drive shaft 4.

Accordingly, the pressing drive member 15 engaged with the right-hand threads **4*b* of the drive shaft 4 is moved toward the operation wheel 22 together with the conical friction member 17 engaged with the notch 15*c* of the first boss part 15*a***.

By this move, the torque transmitting member 18 contacting with both pressing drive member 15 and conical friction member 17 moves toward the operation wheel 22, thereby approaching the inner surface of the outside cover 20B of the operation lever 20 and other constituent members.

However, before the torque transmitting member 18 contacts with the inner surface of the outside cover 20B of the operation lever 20 or other parts, the engaging protrusion **24*a* of the intermediate member 24 rotating together with the drive shaft 4 abuts against the side wall 17*e* of the engaging dent 17*c*1 of the conical friction member 17**.

In consequence, the conical friction member 17, torque transmitting member 18 and pressing drive member 15 are rotated at the same speed and in the same direction as the drive shaft 4, and hence the torque transmitting member 18 is prevented from moving outside in the axial direction along the drive shaft 4.

Therefore, when the rotating direction changeover pawl 29 is selected at the neutral position and the end side of the load chain 37 is pulled, the pressing drive member 15 is maintained in the state not contacting with the inner surface of the outside cover 20B of the operation lever 20 or other parts, so that the smooth free rotation of the load sheave 2 may be effected continuously by a small pulling force.

According to the invention, the following effects are brought about.

In the area of the conical hole of the torque transmitting member, the conical surface of the conical friction member engaged with the pressing drive member contacts in friction with a pressing force set by the thrusting member. Therefore, if the cargo suspended on the lower hook of the load chain is heavier than the rated load, when the operation lever is reciprocally turned in an attempt to rotate the torque transmitting member in the hoisting-up direction, the torque transmitting member cannot rotate the conical friction member and pressing drive member on which a load heavier than the rated load is applied, and idles.

Therefore, lifting of the cargo heavier than the rated load is prevented automatically, and the safety of the work is guaranteed.

Or when the torque transmitting member is moved outside in the axial direction along the drive shaft together with the pressing drive member and the conical friction member engaged therewith, the engaging dent at the large diameter side of the conical friction member and its confronting engaging protrusion of the operation wheel are positioned to contact with each other before the torque transmitting member contacts with the outside cover of the operation lever or other constituent member.

Accordingly, in an unloaded state, when pulling the end side of the load chain by selecting the rotating direction changeover pawl in the neutral position, The torque transmitting member also rotates together with the drive shaft by the operation wheel before the torque transmitting member contacts with the outside cover of the operation lever and other constituent members.

Therefore, the load sheave may be idled smoothly and continuously by a small pulling force, and the lower hook may be moved promptly.

At the outside position in the axial direction of the torque transmitting member, the cylindrical support ring for supporting the outside tubular part of the operation lever is disposed integrally, extending to the outer circumference of the operation wheel, and hence during hoisting-up work, the external pressure from the outside tubular part of the operation lever is not applied to the torque transmitting member through the support ring to be transmitted to the operation wheel.

Hence, the preset rated load (load limit) is not influenced by external pressure from the operation lever applied to the operation wheel, so that an accurate rated load may be always maintained stably.

Practical embodiments illustrated in the detailed description of the invention herein are only intended to clarify the technical context of the invention, and the invention should not be interpreted in a narrow sense by limiting to the above illustrated embodiments alone, but should be understood in a broader sense as being variously modified and embodied within the true spirit and scope of the claims stated below.

What is claimed is:

1. A lever operated hoist comprising:

a drive shaft linked to a load sheave through a gear train, a pressure bearing member fixed on said drive shaft, a pressure drive member disposed on said drive shaft in a manner free to move spirally to and fro in an axial direction, a driving force transmitting mechanism disposed between said pressing drive member and said pressure bearing member for transmitting torque in a hoisting-up direction from said pressing drive member to said pressure bearing member, a conical friction member having an outside conical surface, said conical friction member adapted to be engaged with said pressing drive member in a rotating direction, a torque transmitting member disposed so as to be in frictional contact with said outside conical surface of said conical friction member and adapted to be engaged with an operation lever, an operation member disposed on said drive shaft adjacent to said conical friction member, said operation member and said conical friction member having mutually engageable parts which engage each other in a unloaded state causing said pressing drive member to rotate with said drive shaft, and a cylindrical support ring for supporting an outside tubular part of said operation lever, said cylindrical support ring being disposed at an outside position in the axial direction of the torque transmitting member and extending to an outer circumference of said operation member.

2. A lever operated hoist of claim 1, wherein the operation member comprises an intermediate member spline-coupled on the drive shaft and an operation wheel rotatably disposed on the outer circumference of the intermediate member, and the intermediate member has the engaging part to be engaged in the rotating direction with the engaging part of the conical friction member.

3. A lever operated hoist of claim 1, wherein the outer circumference of the support ring is extended toward the outside in the axial direction with respect to the axial line of the drive shaft, parallel to and inner circumference of the outside tubular part of the operation lever.

4. A lever operated hoist of claim 1, wherein the support ring is made of metal.

5. A lever operated hoist comprising:

a drive shaft linked to a load sheave through a gear train, a pressure bearing member fixed on said drive shaft, a pressing drive member disposed on said drive shaft in a manner free to move spirally to and fro in an axial direction, a driving force transmitting mechanism disposed between said pressing drive member and said pressure bearing member for transmitting torque in a hoisting-up direction from said pressing drive member to said pressure bearing member, a conical friction member adapted to be engaged with said pressing drive member in a rotating direction and having an outside conical surface, a torque transmitting member disposed so as to be in frictional contact with said outside conical surface of said conical friction member and adapted to be engaged with an operation lever, an intermediate member spline-coupled on said drive shaft adjacent to said conical friction member, an operation wheel rotatably disposed on the outer circumference of said intermediate member, wherein said intermediate member and said conical friction member have engaging parts adapted to be mutually engaged, which in a sheave idling state, engage each other and cause said pressing drive member to rotate with said drive shaft, and a cylindrical support ring for supporting an outside tubular part of said operation lever being disposed at an outside position in the axial direction of the torque transmitting member, extending to the outer circumference of the operation wheel.

6. A lever operated hoist of claim 5 further including an engaging protrusion disposed on an outer circumference of said intermediate member, and plural engaging dents disposed at a large diameter side of said conical friction member, so that said engaging protrusion can be engaged with one of said engaging dents.

7. A lever operated hoist of claim 5, wherein the intermediate member and operation wheel are made of metal.

* * * * *